US005888111A

United States Patent [19]

Walker

[11] Patent Number: 5,888,111

[45] Date of Patent: Mar. 30, 1999

[54] INFLATABLE ICE MUD WATER RESCUE CRAFT

[76] Inventor: George Kriston Walker, 7277 Cascade, Boise, Id. 83704

[21] Appl. No.: 986,280

[22] Filed: Dec. 6, 1997

[51] Int. Cl.[6] ..... B63C 9/00

[52] U.S. Cl. ..... 441/80; 441/82; 114/345

[58] Field of Search ..... 114/345; 441/40, 441/80, 82, 66, 129

[56] References Cited

U.S. PATENT DOCUMENTS

| | | | |
|---|---|---|---|
| 3,711,879 | 1/1973 | Siefert . | |
| 3,781,933 | 1/1974 | Soter . | |
| 4,990,114 | 2/1991 | LeBlanc . | |
| 5,170,738 | 12/1992 | Patten . | |
| 5,301,630 | 4/1994 | Genovese et al. . | |
| 5,320,567 | 6/1994 | Beer . | |
| 5,421,757 | 6/1995 | Basiliere . | |
| 5,427,557 | 6/1995 | Lunden | 441/80 |
| 5,492,076 | 2/1996 | Kobayashi | 441/80 |

OTHER PUBLICATIONS

Jim Gorant, Jet Ski Saviors, Popular Mechanics, Dec. 1997, pp. 54–57, U.S.A.

*Primary Examiner*—Stephen Avila
*Attorney, Agent, or Firm*—Charles R. Clark

[57] ABSTRACT

An inflatable ice mud water rescue craft has an inflatable closed-loop tube that encircles a floor member and two rescue openings, one inboard at the bow and one inboard at the stern of the craft. Preferably the floor member is inflatable. The tube and floor member form the boundaries for the two rescue openings. The tube turns upward fore and aft of the floor member at an angle in the range of 30 to 65 degrees relative to the plane of the floor member and encircles the rescue openings. The tube and rescue openings at the bow and stern arch more than half as high as the overall beam of the craft above the surface of the rescue scene. Drowning victims or imperiled persons may be brought into the craft through the rescue openings.

10 Claims, 1 Drawing Sheet

INFLATABLE ICE MUD WATER RESCUE CRAFT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to an inflatable vessel by which an imperiled person may be rescued from thin ice, mud, tidal mud flats, open water, fast water, and riverine environments.

2. Description of Related Art

A number of devices exist that can aid in the rescue of drowning victims in open water or where the victim has fallen through thin ice. The prior devices are generally more cumbersome, bulky, and complex and not as versatile and maneuverable as the present invention. The present invention provides for a more stable rescue device during the rescue process. The present invention also solves maneuverability and stability problems that exist with prior art if use is attempted of the same in fast water and turbulent riverine environments. Particularly, the rescue craft provides more stability during water borne approach by an embarked rescuer or rescuers to low head dams for rescue of imperiled persons in the vicinity of such structures.

BRIEF SUMMARY OF THE INVENTION

The present invention provides a novel rescue craft that is extremely stable and maneuverable in fast water and turbulent water often encountered during rescues in riverine environments.

The invention comprises an inflatable tube that is formed in a closed loop around an elongated floor member that spans and bridges only a portion of the area within the inner periphery of the tube. The area within the periphery of the tube not spanned by the floor member comprises two rescue openings, one inboard at the bow and one inboard at the stern of the craft. The tube turns up at the bow and stern of the craft. The bow and stern of the craft have extreme uplift relative to the plane of the floor member of the craft. Preferably the angle of the uplift of the bow and stern relative to the plane of the floor member is in the range of 30 to 65 degrees. Preferably the uplift is more than half as high as the overall beam of the craft. The rescue openings in the craft are large enough to permit the ready passage of a person up through said openings and onto the floor member.

The uplift of the tube and rescue openings at the bow and stern of the craft arching above the plane of the rescue environment is advantageous. The uplift of the tube and rescue openings allows for imperiled persons to be retrieved into the craft without bringing them over the tube or the necessity of the imperiled person totally submerging to get under the tube and into a rescue opening.

A further advantage in having rescue openings that arch above the surface of the rescue scene plane is that rescuer(s) embarked in the craft can observe and watch the imperiled person through a rescue opening while approaching and is thereby assisted in guiding the craft to and over the person while the person remains above the surface of the rescue scene. In the preferred embodiment, the craft has a floor member that is inflatable. In the preferred embodiment, once the imperiled person is within a rescue opening, the person is encircled by the buoyant air supporting structure provided by the tube and floor member of the craft. The encircling of a rescue opening by the tube and floor member increases the stability of the craft while the imperiled person transits through said rescue opening.

A further object of the invention is to provide rescuers with a device with improved stability and rescuer safety. For example the invention provides for increased safety in a rescue effort in that it permits a team of two or more rescuers to embark for transit in the craft to an imperiled person needing rescue from thin ice, mud, fast water, turbulent water, and riverine environments. Particularly in thin ice and tidal mud flat rescue environments, one or more rescuers can maneuver the craft from positions of safety within the rescue openings while gripping grablines or other portions of the craft.

Another object of the invention is to permit safe approach to rescue scenes at low head dams. The uplift at the bow and stern of the craft provides greater stability to the craft in the turbulent waters often encountered at low head dams. The uplift makes the craft less likely to overturn and facilitates close approach to the waterfall pour-over face of the low head dam, the place where a victim is often trapped by turbulent water. The uplift helps prevent the craft from tumbling in both longitudinal and side approaches of the craft to the waterfall pour-over face.

Towlines, tow bridles and anchor lines may be attached to the invention for convenient and stable towing by other water craft such as jet skis or for anchoring the craft to secure anchor points or for hauling in of the craft from the rescue scene to positions of greater safety. Additionally, grablines may be attached to the craft for gripping by rescuer(s) or imperiled person(s).

A further object of the invention is to provide rescuers in the rescue of persons trapped in the adhesive grip of tidal mud flats with a safe work platform. The rescue craft can be maneuvered over the trapped person so the person is within a rescue opening. Lines or straps may then be secured to the person and the craft to provide buoyant lift when the tide begins to come in and water begins to inundate the rescue scene. The rescuers in the mud flat environment can work from within the safety of the buoyant perimeter of the invention.

DETAILED DESCRIPTION OF THE INVENTION

Figure 1:
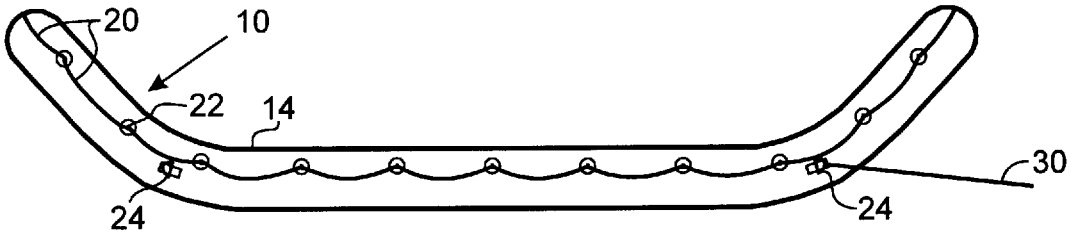
FIG. 1 is a diagrammatic side elevation view of the rescue craft
Figure 2:
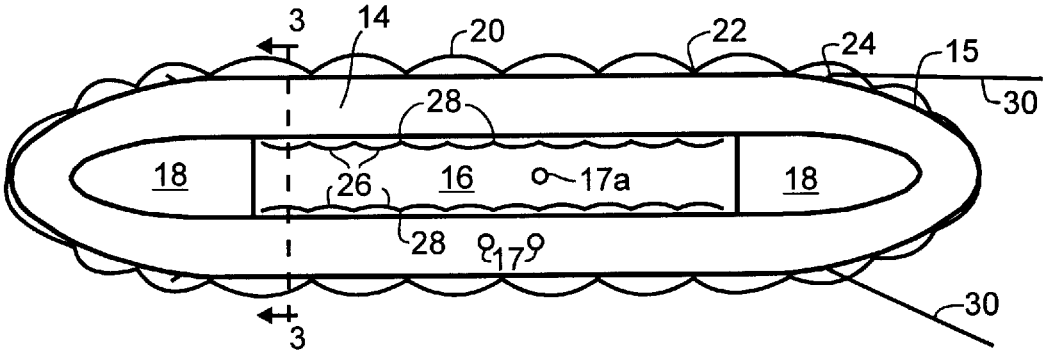
FIG. 2 is a diagrammatic top plan view of the rescue craft.

FIGS. 1 and 2 generally illustrate a general embodiment of an inflatable rescue craft 10 that may be manufactured to be used in the rescue of imperiled persons from thin ice, mud, tidal mud flat, open water, fast water, or riverine environments.

Figure 4:
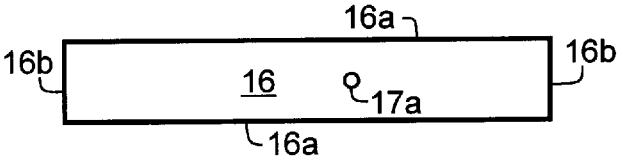
FIG. 4 is a diagrammatic top plan view of the floor member of the rescue craft.

As shown in the figures, the craft 10 comprises an inflatable closed-loop tube 14 encircling an elongated floor member 16 and two rescue openings 18. The floor member 16 has two sides 16*a* and two ends 16*b* as illustrated in FIG. 4. The floor member 16 in the preferred embodiment is inflatable. The tube 14 is attached to the floor member 16 along the sides 16*a* by conventional attachment means that include sealing, gluing, lacing, sewing, zippering, bolting and other similar methods. The tube 14 extends longitudinally fore and aft beyond the sides 16*a* and turns up at an angle relative to the plane of the floor member 16 in the range of 30 to 65 degrees. The tube 14 as it extends fore and aft beyond the sides 16*a* is not attached to the ends 16*b* of the floor member 16 and with the ends 16*b* forms two rescue openings 18. Each said rescue opening 18 is bounded by the tube 14 and a respective end 16*b* of the floor member 18. A rescue opening 18 is formed respectively inboard of the bow and inboard of the stern of the craft 10.

Figure 3:
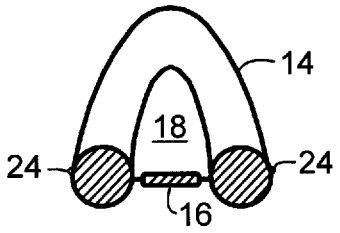
FIG. 3 is a diagrammatic sectional elevation view of the rescue craft taken along the line 3—3 of FIG. 2 and looking in the direction of the arrows.

As shown in FIG. 1, the tube 14 curves upward and forms a bow and a stern for the craft 10 well above the plane of the bottom of the central portion of the craft 10. In the preferred embodiment of the craft 10, the bow and stern are similarly shaped. FIG. 3 illustrates that a rescue opening 18 extends well above the plane of the floor member 16.

FIGS. 1 and 2 illustrate grablines 20 that are attached by conventional attachment means 22 to the outer periphery 15 of the tube 14. FIGS. 1 and 2 also illustrate conventional anchor attachment means 24 to which tow lines 30, tow bridles, and anchor lines may be attached to the craft 10. Conventional attachment means 22 and anchor attachment means 24 include D-rings and similar connecting devices.

FIG. 2 illustrates gripping lines 26 mounted by connecting means 28 to the floor member 16 generally longitudinally and parallel to the sides 16*a* of the floor member 16. A plurality of gripping lines 26 may be attached to the floor member 16. The gripping lines 26 preferably are made of a fabric or a webbing that is anchored sequentially by a plurality of connecting means 28 along the length of each gripping line 26 to the floor member 16. During the attachment process of a gripping line 26, the segment of gripping line 26 between each sequential set of connecting means 28 is longer than the shortest distance between each such set. The attachment process results in a series of loops in the gripping lines 26 that may be used for gripping by an imperiled person or a rescuer or for securing rescue gear. Connecting means 28 include D-rings, bolts, sewing and other equivalent connecting devices.

The craft 10 may be constructed using conventional methods and techniques of manufacture of inflatable rafts from a variety of materials. Preferably the tube 14 and floor member 16 are constructed of urethane and or PVC coated woven fabric that is tear and puncture resistant. The tube 14 and floor member 16 may be fluidly connected thereby allowing the entire craft 10 to be inflated through a single valve. FIGS. 2 and 4 illustrate an inflation valve 16 installed in the floor member 16. FIG. 2 shows two inflation valves 17 installed in the tube 14.

The tube 14 may be constructed with a single inflatable chamber or a plurality of inflatable chambers. Alternatively, the tube 14 may be a sleeve-like structure containing one or more inflatable bladders. Preferably the tube 14 contains two inflatable U-shaped chambers each equipped with an inflation valve 17, one chamber forming the forward half of the craft 10 and one forming the rear half of the craft 10. The tube 14 and floor member 16 in the preferred embodiment are inflatable by means comprising inflation valves installed in each inflatable component.

When inflated, craft 10 is relatively rigid and preferably about 4.5 to 5 meters (about 15 to 16 feet) in overall length and about 1.2 meters (about 4 feet) in overall beam. The tube 14 is preferably about 0.3 meters (about 12 to 14 inches) in cross-sectional diameter and may taper slightly as it approaches the bow and stern of the craft 10. The floor member 16 is preferably rectangular in shape with sides 16*a* of about 2.4 meters (about 8 feet) long and ends 16*b* of about 0.6 meters (about 2 feet) wide.

The craft 10 is used for water borne transport of rescuers to a water rescue scene. For thin ice or tidal mud flat rescue scenes, the craft 10 may be carried or slid along the surface of the ice or mud surfaces. The craft 10 accomplishes its objects, has utility, is novel, and is an improvement over the prior art.

I claim:

1. A rescue craft, comprising:

an elongated floor member, said floor member having two sides and two ends, an inflatable closed-loop tube connected to said sides, said tube extending longitudinally fore and aft and turning up beyond said ends at an angle relative to the plane of the floor member in the range of 30 to 65 degrees and encircling two rescue openings.

2. A rescue craft according to claim 1 wherein said floor member is inflatable.

3. A rescue craft according to claim 2 further comprising means to inflate said tube and said floor member.

4. A rescue craft according to claim 3 wherein said means to inflate includes a valve positioned in said tube and a valve positioned in said floor member.

5. A rescue craft according to claims 1 or 2 further comprising gripping means positioned on said floor member to assist the imperiled person in passing upward and through said rescue openings.

6. A rescue craft according to claim 5 wherein said gripping means includes a plurality of grip lines mounted longitudinally on said floor member and parallel to said sides.

7. A rescue craft according to claims 1 or 2 further comprising means on said tube to attach a plurality of grablines.

8. A rescue craft according to claim 7 wherein said means on said tube includes a plurality of D-rings mounted to the outer surface of said tube and distributed along its outer periphery.

9. A rescue craft according to claims 1 or 2 further comprising means on said tube to attach a plurality of towlines.

10. A rescue craft according to claim 9 wherein said means on said tube includes a plurality of D-rings mounted to the outer surface of said tube and distributed along its outer periphery.

* * * * *